US010368644B1

(12) United States Patent
Haingaertner

(10) Patent No.: US 10,368,644 B1
(45) Date of Patent: Aug. 6, 2019

(54) FOLDING ROCKING CHAIR

(71) Applicant: Andy Haingaertner, Rogers, AR (US)

(72) Inventor: Andy Haingaertner, Rogers, AR (US)

( * ) Notice: Subject to any disclaimer, the term of this patent is extended or adjusted under 35 U.S.C. 154(b) by 0 days.

(21) Appl. No.: 15/921,777

(22) Filed: Mar. 15, 2018

Related U.S. Application Data

(60) Provisional application No. 62/472,004, filed on Mar. 16, 2017.

(51) Int. Cl.
*A47C 4/28* (2006.01)
*A47C 3/029* (2006.01)

(52) U.S. Cl.
CPC ..... *A47C 4/28* (2013.01); *A47C 3/029* (2013.01)

(58) Field of Classification Search
CPC ..... A47C 4/44
USPC ..... 297/46, 47, 48, 32, 18
See application file for complete search history.

(56) References Cited

U.S. PATENT DOCUMENTS 700,266 A * 5/1902 Wagner ..... A47C 4/14 297/32
2,767,776 A * 10/1956 Allen ..... A47C 4/20 297/47
4,118,064 A 10/1978 Robeson ..... 297/18
4,241,950 A 12/1980 Simpson ..... 297/18
4,285,543 A * 8/1981 Clark ..... A47C 3/029 297/133
4,405,172 A * 9/1983 Ferneau ..... A61G 1/0565 296/20
4,556,249 A * 12/1985 Kassai ..... A47D 1/02 297/30
4,685,725 A 8/1987 Helfrich ..... 297/45
4,772,067 A 9/1988 Fowler
5,560,675 A 10/1996 Altheimer et al. ..... 297/33
5,803,548 A 9/1998 Battle ..... 297/440.13
D408,640 S 4/1999 Good ..... 6/348
6,086,147 A * 7/2000 Gladstone ..... A47C 3/029 297/133
6,174,028 B1 1/2001 Yang et al. ..... 297/258.1
6,206,462 B1 * 3/2001 Huang ..... A47C 4/20 297/16.1
6,257,660 B1 7/2001 Calvey ..... 297/16.1
6,354,657 B1 3/2002 Nelson et al. ..... 297/56
6,398,297 B1 6/2002 Cantwell ..... 297/33
6,843,527 B2 1/2005 Nelson et al. ..... 297/18
7,100,975 B1 9/2006 Zheng ..... 297/32
2016/0286963 A1 * 10/2016 Yang ..... A47C 4/44
2017/0156500 A1 * 6/2017 Lv ..... A47C 4/18

FOREIGN PATENT DOCUMENTS

WO WO-2015139252 A1 * 9/2015 ..... A47C 3/029

* cited by examiner

*Primary Examiner* — David E Allred
(74) *Attorney, Agent, or Firm* — Keisling & Pieper PLC; David B. Pieper

(57) ABSTRACT

A folding rocking chair frame using both K shaped and straight compactable side frames to support a seat off of rocking rails. The folding frame using an over center back leg, mid positioning leg, and front leg with a front positioned lock.

10 Claims, 11 Drawing Sheets

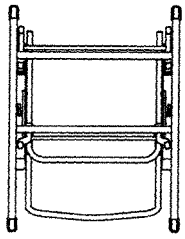
Fig 10
BACK
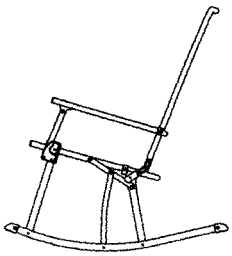
LEFT Fig 11
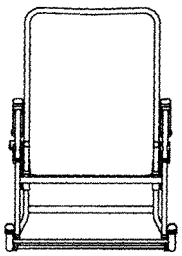
FRONT Fig 12
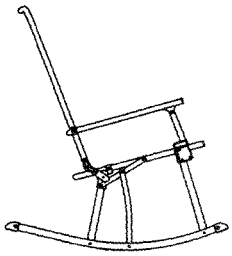
RIGHT
Fig 13
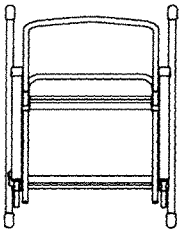
TOP
Fig 14

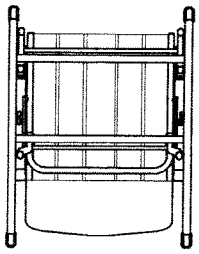
BACK Fig.15
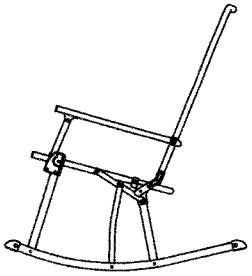
LEFT Fig16
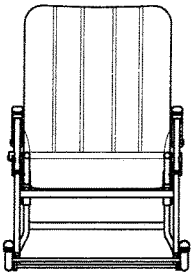
FRONT Fig17
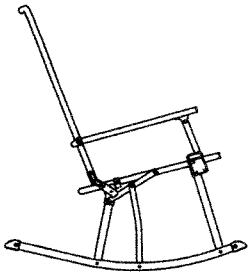
RIGHT Fig18
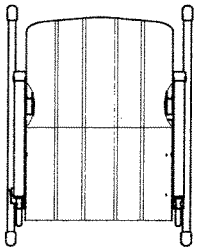
TOP Fig19

FOLDING ROCKING CHAIR

CROSS-REFERENCE TO RELATED APPLICATIONS

This application claims priority to and is a continuation-in-part of U.S. Provisional Application Ser. No. 62/472,004 filed on Mar. 16, 2017 which is incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in folding rocking chairs. More particularly, the invention relates to improvements particularly suited for compacting and transporting a folding rocking chair with suitable strength for the rocking motion. In particular, the present invention relates specifically to a folding rocking chair with a locking frame.

2. Description of the Known Art

As will be appreciated by those skilled in the art, folding chairs are known in various forms. Patents disclosing information relevant to folding chairs include: U.S. Pat. No. 7,100,975, issued to Zheng on Sep. 5, 2006, entitled Collapsible rocking chair; U.S. Pat. No. 6,843,527, issued to Nelson, et al. on Jan. 18, 2005, entitled Multi-functional portable folding rocking chair; U.S. Pat. No. 6,398,297, issued to Cantwell on Jun. 4, 2002, entitled Collapsible rocking chair; U.S. Pat. No. 6,354,657, issued to Nelson, et al. on Mar. 12, 2002, entitled Multi-functional portable folding rocking chair; U.S. Pat. No. 6,257,660, issued to Calvey on Jul. 10, 2001, entitled Foldable and portable furniture assembly; U.S. Pat. No. 6,174,028, issued to Yang, et al. on Jan. 16, 2001, entitled Infant rocking chair; U.S. Pat. No. D408,640, issued to Good on Apr. 27, 1999, entitled Folding rocking chair; U.S. Pat. No. 5,803,548, issued to Battle on Sep. 8, 1998, entitled Collapsible chair apparatus; U.S. Pat. No. 556,067, issued to 5 Altheimer, et al. on Oct. 1, 1996, entitled Folding rocking chair; U.S. Pat. No. 4,772,067, issued to Fowler on Sep. 20, 1988, entitled Folding platform rocker; U.S. Pat. No. 4,685,725, issued to Helfrich on Aug. 11, 1987, entitled Seating apparatus; U.S. Pat. No. 4,241,950, issued to Simpson on Dec. 30, 1980, entitled Folding chair; and U.S. Pat. No. 4,118,064, issued to Robeson on Oct. 3, 1978, entitled Collapsible folding rocking chair. These various designs fail to disclose the folding rocking chair of the present invention. Thus, it may be seen that these prior art patents are very limited in their teaching and utilization, and an improved folding rocking chair is needed to overcome these limitations.

SUMMARY OF THE INVENTION

The present invention is directed to an improved folding rocking chair using a frame and covering cloth. Two folding side frames are disclosed connected by rigid cross members. In accordance with one exemplary embodiment of the present invention, rigid arms are connected to seat side frame rails that are vertically compacted using front legs, mid legs, and over center back legs. A front open position lock and closing release button are also provided. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 10 is a back view of the frame in an open position.

FIG. 11 is a left side view of the frame in an open position.

FIG. 12 is a front view of the frame in an open position.

FIG. 13 is a right side view of the frame in an open position.

FIG. 14 is a top view of the frame in an open position.

FIG. 15 is a back view of the fabric covered frame in an open position.

FIG. 16 is a left side view of the fabric covered frame in an open position.

FIG. 17 is a front view of the fabric covered frame in an open position.

FIG. 18 is a right side view of the fabric covered frame in an open position.

FIG. 19 is a top view of the fabric covered frame in an open position.

DETAILED DESCRIPTION OF THE INVENTION

Figure 1:
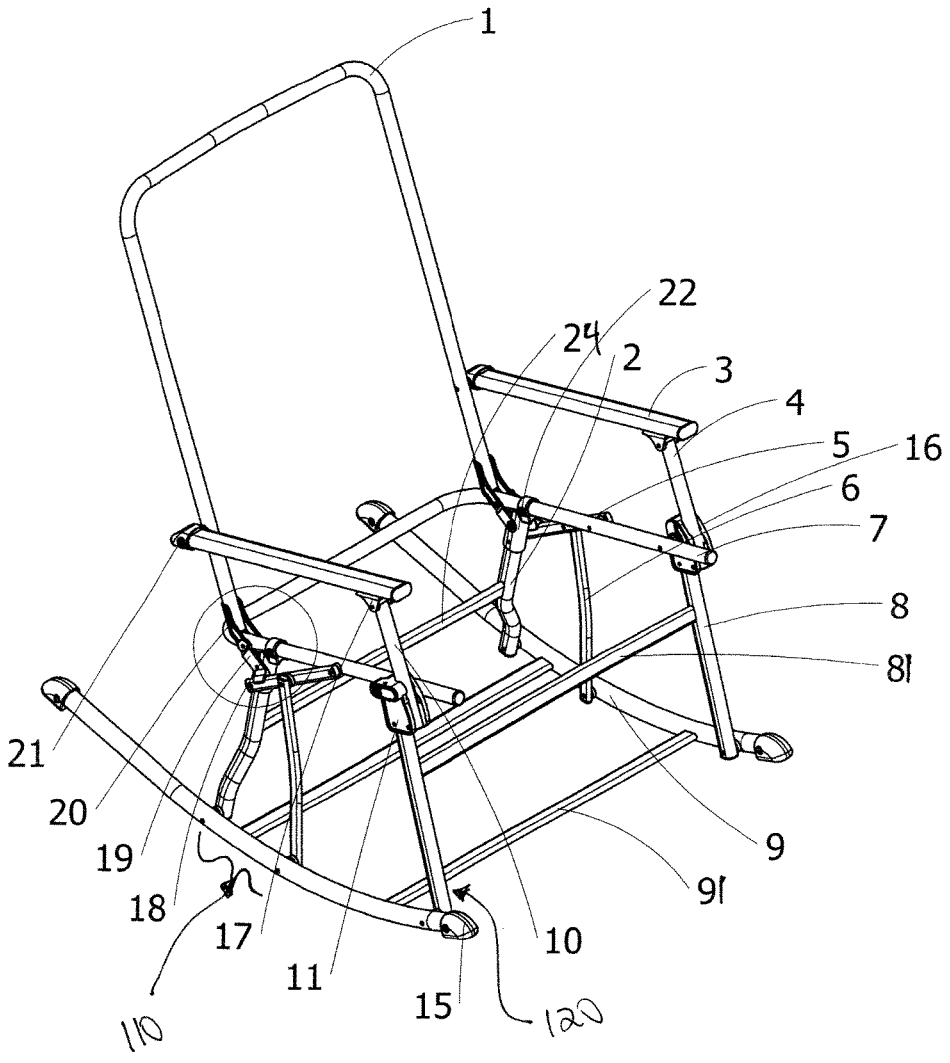
FIG. 1 is a perspective view of the folding frame in an open position.
Figure 2:
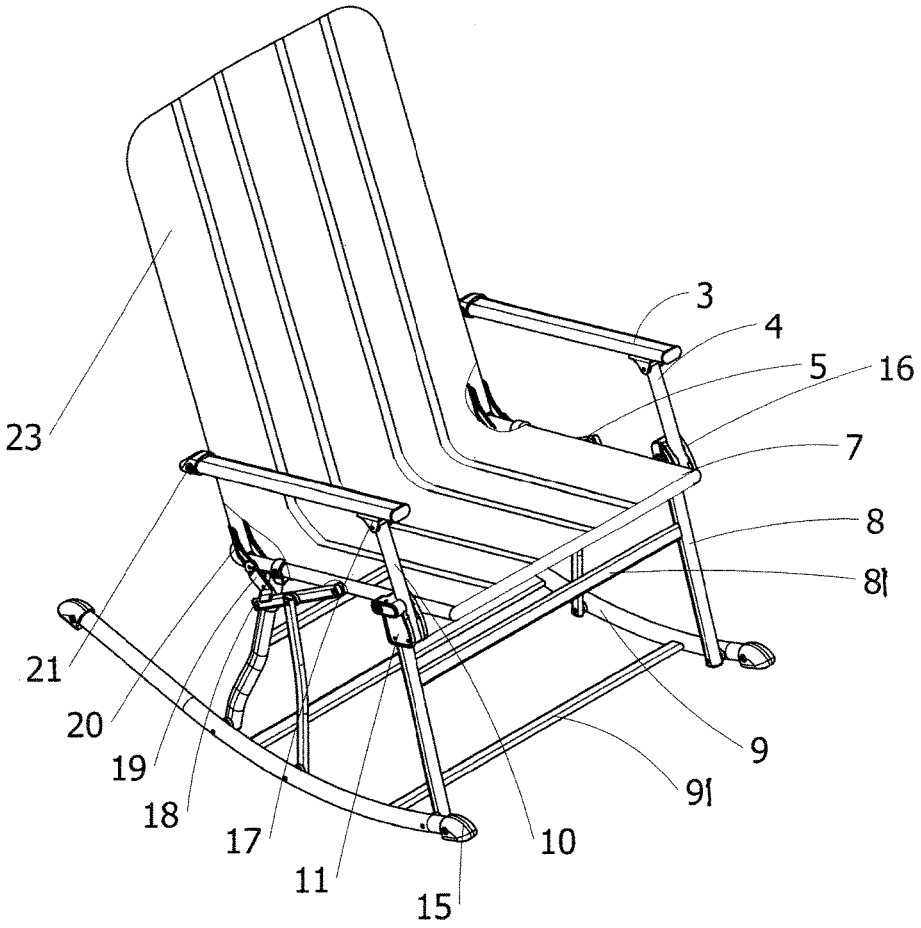
FIG. 2 is a perspective view showing the frame with a fabric seat and back.
Figure 3:
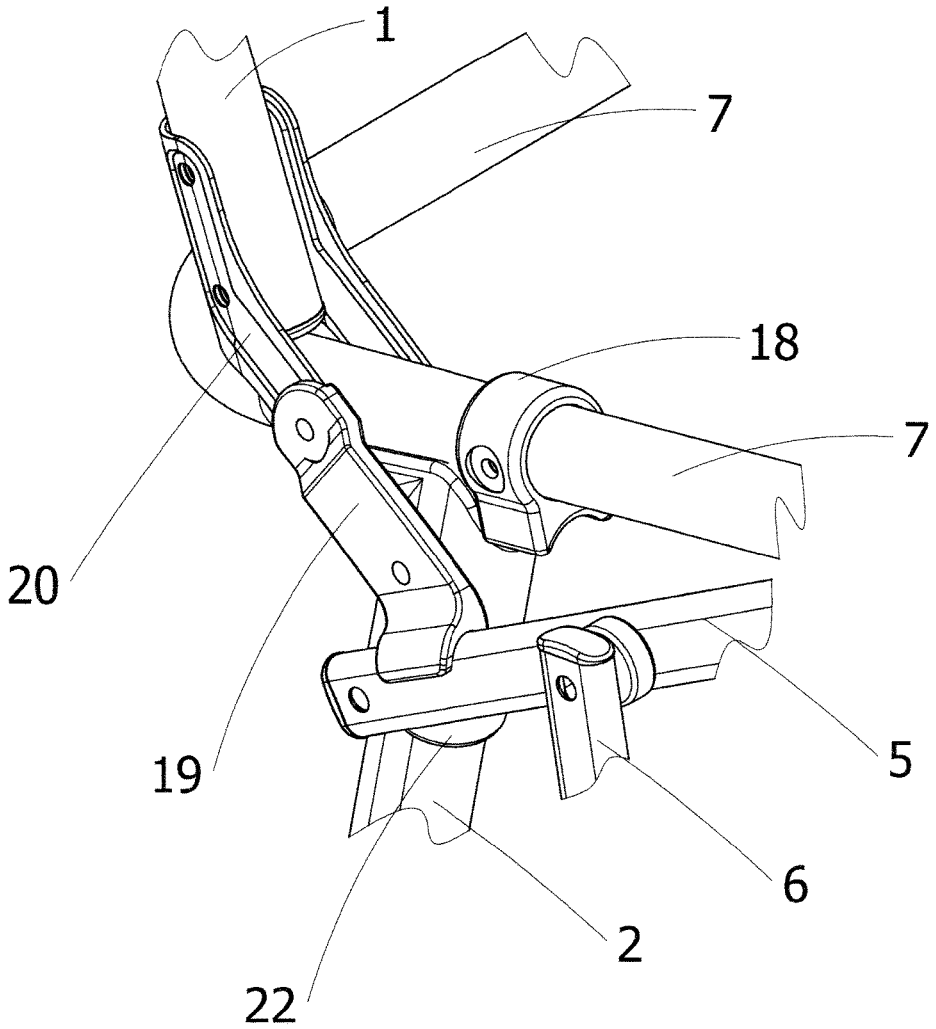
FIG. 3 shows the over center back leg connection.
Figure 4:
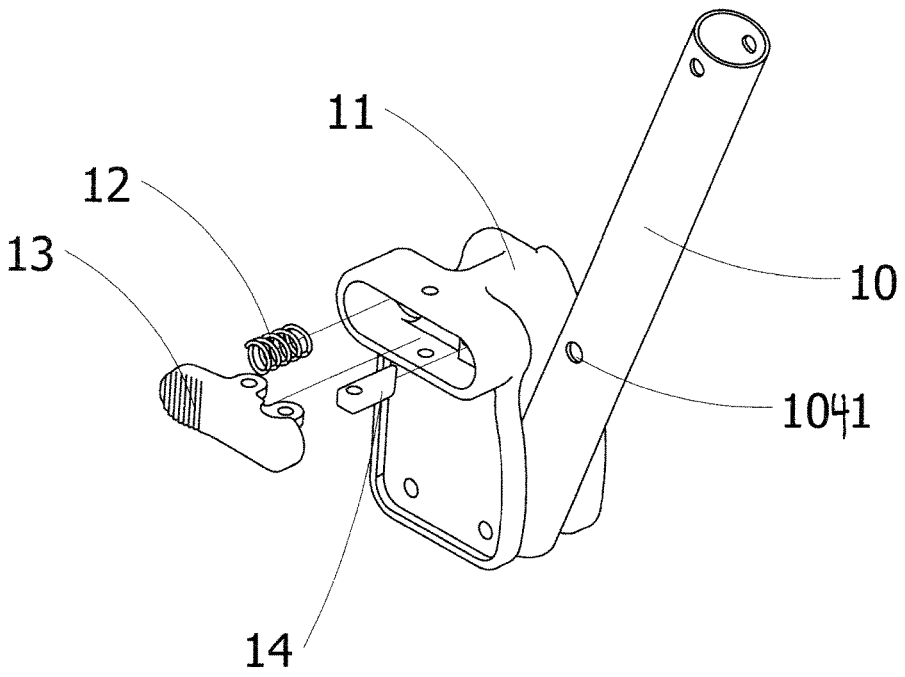
FIG. 4 shows the front lock.
Figure 5:
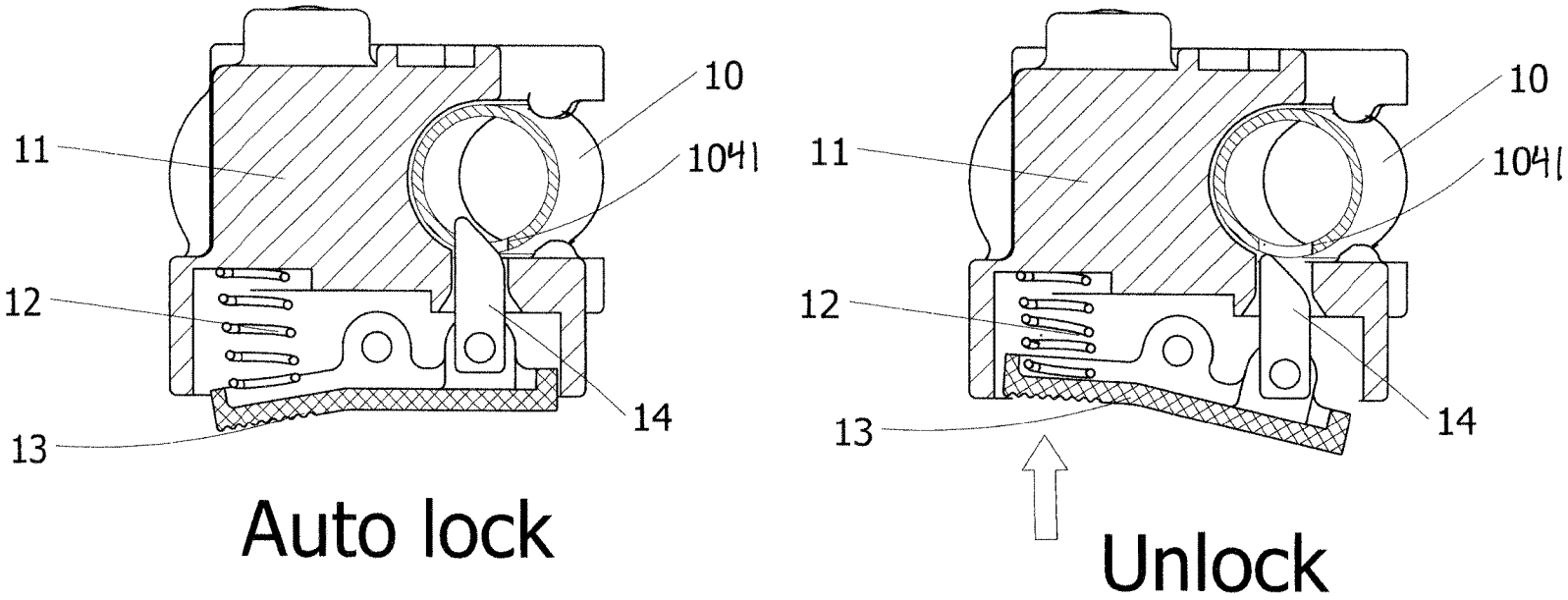
FIG. 5 shows a schematic view of the operation of the front lock.
Figure 6:
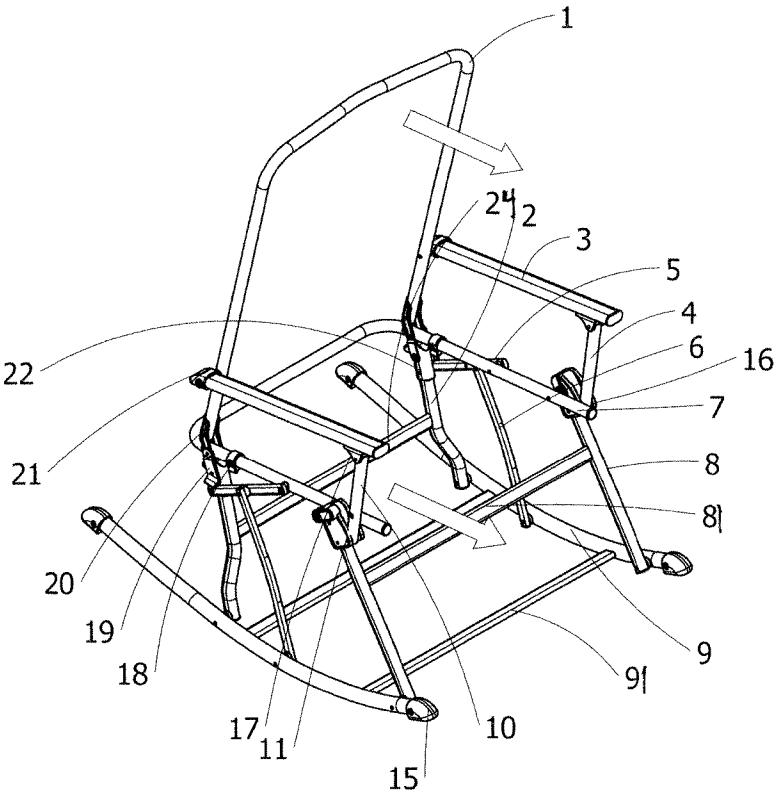
FIG. 6 is a perspective view of the folding frame in an initial folding position.
Figure 7:
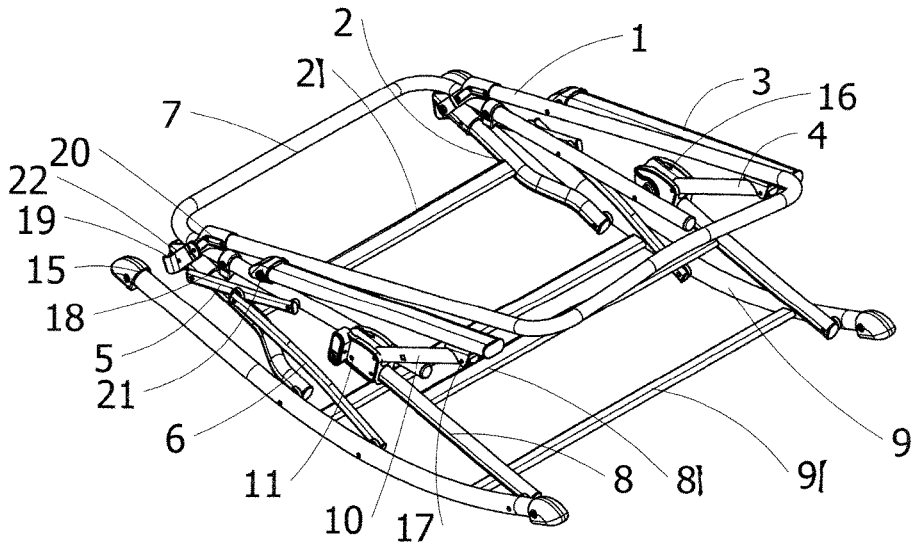
FIG. 7 is a perspective view of the folding frame in a mostly folded position.
Figure 8:
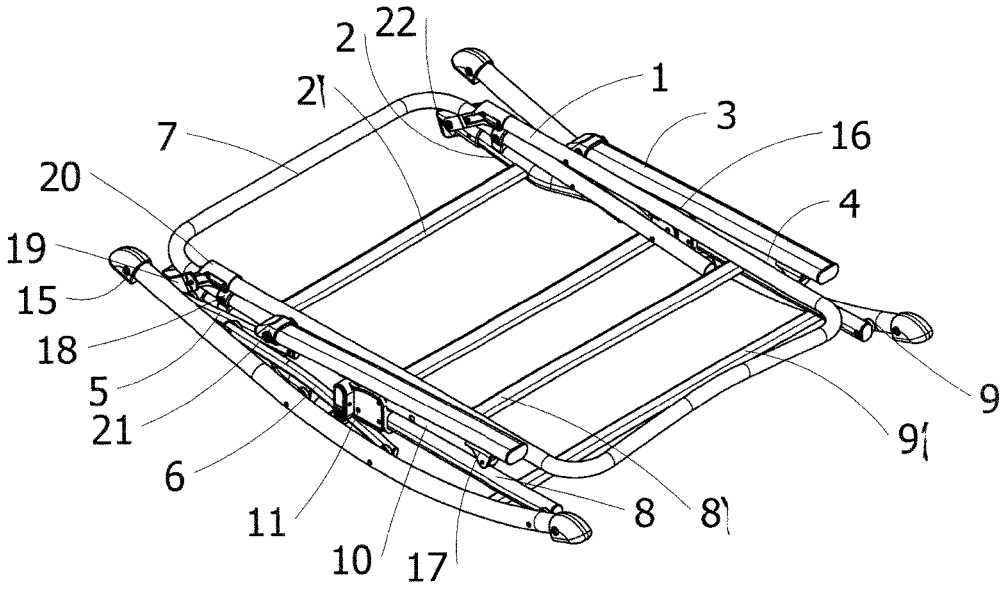
FIG. 8 is a perspective view of the folding frame in a fully compacted position.
Figure 9:
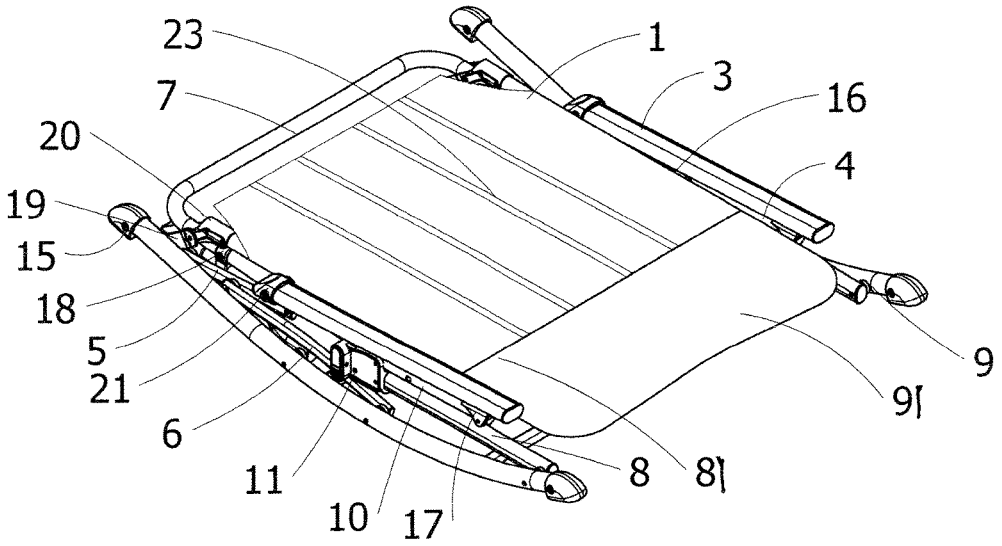
FIG. 9 is a perspective view of the compacted position with the fabric seat and back.

As shown in FIGS. 1 through 19 of the drawings, one exemplary embodiment of the present invention is generally shown as a folding chair 100.

The folding chair 100 is made using a back frame 1 that is a tubular U-shaped member extending vertically up the sides of the back of the chair and across the top of the back of the chair.

The back frame 1 is pivotally connected by the back arm pivot 21 to the arm rail 3. The arm rail 3 is pivotally connected by the front arm hinge 17 on the right side to the right front arm support 4 and on the left side to the left front arm support 10. These arm supports 4, 10 are uniquely called out in the construction because the locking aperture 1041 is positioned in the preferred embodiment on the outside of each support 4, 10 to work with either the left front locking member 11 or the right front locking member 16.

Returning to the back frame 1 we note that the back frame 1 is rigidly connected by rivets to the back leg hinge frame 20. The back leg hinge frame 20 is a u shaped piece with extending arms that is riveted to the back leg over center bar 19 and the seat rail 7. The back leg over center bar 19 is shaped with fingers forming an indention to fit over the back leg hinge frame 20 such that is if fixedly connected to the back frame 1, but the same rivet also allows all three of the back frame 1, the back leg hinge frame 20, and the back leg over center bar 19 to all pivot in relation to the seat rail 7. The seat rail 7 is another tubular U shaped member that extends along the sides of the chair 100 and across the back of the chair 100.

The back of the seat rail 7 is connected via a pivoting k arm suspension 110 to the rocking rails 9 and the front of the seat rail is connected via a straight pole suspension 120. The pivoting k arm suspension includes the back leg 2; forward mid hinge arm 5; mid vertical leg 6; back leg rail stop 18; back leg over center bar 19; and back leg stop 22. The front of the seat rail 7 is connected via a straight pole suspension 120 to the rocking rails 9. The straight pole suspension 120 includes the front leg 8 and the front locking member. Each of these suspensions 110, 120 may be understood by the detail herein.

The seat rail 7 is used to fixably position the upper back leg rail stop 18 to engage the lower back leg stop 22 so that the seat rail 7 can rest on the either the left or right back leg 2 as appropriate. The seat rail 7 is pivotally connected to the front of the forward mid hinge arm 5. The mid portion of the forward mid hinge arm 5 is pivotally connected to the mid vertical leg 6. The back of the forward mid hinge arm 5 is pivotally connected to the back leg 2. The bottom of the back leg over center bar 19 supportably engages the forward mid hinge arm 5 between the mid vertical leg 6 and the back leg 2 to hold the forward mid hinge arm 5 when the chair 100 is in the open position.

The support fabric 23 is stretched across and connected to both the back frame 1 and seat rail 7.

The left and right back leg 2 are rigidly connected by a back leg cross member 24. The bottom of the left and right back leg 2 is each pivotally connected to the left or right rocking rail 9 as appropriate.

The bottom of the left and right mid vertical leg 6 is each pivotally connected to the left or right rocking rail 9 as appropriate.

Both the left and right rocking rail 9 are a curved tubular member capped by a rail end foot 15 at each end. The left and right rocking rail 9 are rigidly connected by both a front and back rocking cross member 91.

The left and right front arm support 4, 10 is each pivotally connected into the appropriate left or right front locking member 11, 16. Each front locking member 11, 16 uses a bias spring 12 to bias a pivotally mounted lock button 13 to engage and disengage an angled lock pin 14 into the locking aperture 1041 to lock the chair in the open position or release the front arm support 4, 10 for folding to a compacted position. The lock button 13 is pivotally connected to the appropriate front locking member 11, 16. The angled locking pin is pivotally connected to the appropriate lock button 13.

Each front locking member 11, 16 is fixedly connected to a left or right front leg 8. The left and right front leg 8 are rigidly connected by a front leg cross member 81.

Reference numerals are used consistently throughout the detailed description and the drawings correspond to the various elements.

folding chair 100
back frame 1
back leg 2
back leg cross member 24
arm rail 3
right front arm support 4
forward mid hinge arm 5
mid vertical leg 6
seat rail 7
front leg 8
front leg cross member 81
rocking rail 9
front rocking cross member 91
left front arm support 10
locking aperture 1041
front locking member 11
bias spring 12
lock button 13
angled lock pin 14
rail end foot 15
front locking member 16
front arm hinge 17
back leg rail stop 18
back leg over center bar 19
back leg hinge frame 20
back arm pivot 21
back leg stop 22
support fabric 23
pivoting k arm suspension 110
straight pole suspension 120

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element.

The words 'defining,' having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A folding rocking chair apparatus, comprising:

a u-shaped seat rail having a front and a back;

a fabric connected to the seat rail;

a rocking rail;

the back of the u shaped seat rail connected via a pivoting k arm suspension to the rocking rail; and the front of the seat rail connected via a straight pole connection to the rocking rail;

wherein the pivoting k arm suspension is connected to the rocking rail via at least one forward connection and one rearward connection and comprises a "K" configuration when the folding rocking chair is in an unfolded configuration.

2. The apparatus of claim 1, the pivoting k arm suspension further comprising:

a back leg pivotally connected to the rocking rail;

a mid vertical leg pivotally connected to the rocking rail; and a forward mid hinge arm pivotally connected to the back leg and the mid vertical leg.

3. The apparatus of claim 1, the pivoting k arm suspension further comprising:

a back leg stop fixedly positioned on the back leg.

4. The apparatus of claim 1, the pivoting k arm suspension further comprising:

a back leg rail stop fixedly positioned on the seat rail.

5. The apparatus of claim 1, the pivoting k arm suspension further comprising:

a back leg over center bar connected to the seat rail.

6. The apparatus of claim 1, the straight pole connection further comprising:

a front leg pivotally connected to the rocking rail; and a front locking member fixed connected to the front leg and pivotally connected to the seat rail.

7. The apparatus of claim 6, further comprising:

a back frame pivotally connected to the seat rail;

an arm rail pivotally connected to the back frame; and and a front arm support pivotally connected to the arm rail.

8. The apparatus of claim 6, further comprising:

the front arm defining a locking aperture; and the front locking member including a lock pin positioned to engage the locking aperture.

9. The apparatus of claim 8, further comprising:

the front locking member including a pivotally mounted lock button that is pivotally connected to the lock pin.

10. The apparatus of claim 9, further comprising:

a bias spring positioned to bias the pivotally mounted lock button.

* * * * *